US006942010B2

(12) United States Patent
Osugi et al.

(10) Patent No.: US 6,942,010 B2
(45) Date of Patent: Sep. 13, 2005

(54) GRAVITY TYPE TILTABLE METAL MOLD CASTING MACHINE

(75) Inventors: Mitsuharu Osugi, Toyokawa (JP); Eiji Naruse, Toyokawa (JP); Yuji Kanayama, Toyokawa (JP); Yutaka Murata, Toyokawa (JP)

(73) Assignee: Sintokogio, Ltd., Nagoya (JP)

( * ) Notice: Subject to any disclaimer, the term of this patent is extended or adjusted under 35 U.S.C. 154(b) by 244 days.

(21) Appl. No.: 10/466,262

(22) PCT Filed: Jan. 16, 2002

(86) PCT No.: PCT/JP02/00230

§ 371 (c)(1),
(2), (4) Date: Jul. 15, 2003

(87) PCT Pub. No.: WO02/055237

PCT Pub. Date: Jul. 18, 2002

(65) Prior Publication Data

US 2004/0065429 A1 Apr. 8, 2004

(30) Foreign Application Priority Data

Jan. 16, 2001 (JP) ..... 2001-007266

(51) Int. Cl.[7] ..... B22D 33/02; B22D 35/04
(52) U.S. Cl. ..... 164/336; 164/337
(58) Field of Search ..... 164/136, 336, 164/337, 335

(56) References Cited

U.S. PATENT DOCUMENTS 2,429,146 A 10/1947 Wessel ..... 22/151
5,704,413 A 1/1998 Takasaki et al. ..... 164/136

FOREIGN PATENT DOCUMENTS

JP 5-318090 3/1993
JP 6-304695 * 11/1994

* cited by examiner

*Primary Examiner*—Len Tran
(74) *Attorney, Agent, or Firm*—Finnegan, Henderson, Farabow, Garrett & Dunner, L.L.P.

(57) ABSTRACT

A gravity type tiltable metal mold casting machine, comprising: a pair of opposing upright supporting frames (2, 2); a pair of opposing main rotating shafts (3, 3) rotatably mounted on the upright supporting frames (2, 2); a main frame (4) suspended from and between the main rotating shafts (3, 3); an electric motor (19) attached to one of the main rotating shafts (3, 3) for reversibly rotating it and hence the frame (4); a drag die plate (6) vertically moved by mold-fastening cylinders (5, 5) mounted on a lower part of the main frame (4); a metal drag (10) secured to the drag die plate (6), the metal drag having a drag pushing-out mechanism (23) for pushing an as-cast product out of the metal drag; a pair of opposing horizontal cope tilting shafts (13, 13) secured to an upper end of the main frame at locations rearward of the main rotating shafts (3, 3); a cope-attaching frame (14) rotatably mounted at one end on the cope tilting shafts (13, 13); a cope die plate (16) secured to a lower surface of the cope-attaching frame (14); a metal cope (17) secured to the cope die plate (16), the metal cope having a cope pushing-out mechanism (26) for pushing an as-cast product out of the metal cope, a ladle (21) rotatably mounted about a horizontal axis of rotation, the horizontal axis of rotation being located rearward of the assembly of the metal cope and drag; and an electric motor (9) for reversibly rotating the ladle (21) about the horizontal axis of rotation, wherein the center of the assembly of the metal cope and drag is substantially on the axis of rotation of the main rotating shafts.

2 Claims, 5 Drawing Sheets

GRAVITY TYPE TILTABLE METAL MOLD CASTING MACHINE

FIELD OF THE INVENTION

This invention relates to a gravity type tiltable metal mold casting machine wherein molten metal (for example, aluminum) is poured into a mold cavity formed by a metal cope and a metal drag while they are being tilted.

DESCRIPTION OF THE PRIOR ART

Such a conventional gravity type tiltable metal mold casting machine is disclosed in JP H5-318090A. This machine is configured such that both the rotation of the entire casting machine and the rotation of the metal cope (i.e., releasing the upper opening of the metal drag) are performed around a common axis (an axis of rotation located outside the metal cope and drag assembly).

Since in this machine the axis of rotation of the machine and the axis of rotation of the metal cope are the same, the single axis of rotation must be located outside the metal cope and drag assembly so as to make the upper part of the drag be completely open when the metal cope is opened. Thus, when the molds are tilted and molten metal is poured into them, the center of the mold assembly rotates at a location away from the axis of rotation, thereby exerting great rotatory inertia to the molten metal flowing in the molds. This molten metal flowing in the mold assembly with the great rotatory inertia tends to swirl and thus tends to convolute the air, thus producing oxide films, and tends to convolute the films. To prevent such films from being generated and convoluted, the mold assembly must be moved such that it will not have great rotatory inertia. However, in the above-mentioned machine, which has the axis of rotation outside the mold assembly, the rotatory inertia can be reduced to a certain extent by minimizing the tilting radius of the machine to lower its peripheral speed. This causes a problem in that the period of the tilting stroke of the machine must be prolonged.

Further, due to the limitation in minimizing the tilting radius of the machine, and since a cylinder for lowering the cope as well as for fastening the cope and the drag and a cylinder for actuating a mechanism for pushing out an as-cast product are aligned, devices located below the drag are inherently long, and the machine inherently has a great tilting radius (i.e., a great rotatory inertia). Thus a large space must be prepared to install the machine. Further, there is another problem in that the height from the surface on which the machine is installed to the metal drag is great. This makes difficult the operations of putting cores in the drag and taking out an as-cast product. Thus the machine requires a pit or a worktable to easily perform such operations.

The present invention has been conceived in view of the problems discussed above. It aims to provide a gravity type tiltable metal mold casting machine that does not require extending the period of the tilting stroke in order to prevent air and oxide films from being convoluted in molten metal, that has a minimized tilting radius of the mold assembly so that its peripheral speed is controlled to be low, that itself has a minimized tilting radius and a low profile so that the machine is compact, that gives access to the cope by releasing the upper opening of the drag when the cope is opened, that can reduce the space needed for its installation without hindering the operations of putting cores in the metal drag and removing an as-cast product, and that can be installed without preparing a pit.

SUMMARY OF THE INVENTION

To the above end, the gravity type tiltable metal mold casting machine of the present invention includes a pair of opposing upright supporting frames; a pair of opposing main rotating shafts disposed on an axis of rotation and rotatably mounted on the upper ends of the upright supporting frames; a main frame fixedly mounted on the rotating shafts such that it is suspended from and between them; a drag die plate moved vertically by mold-fastening cylinders mounted on a lower part of the main frame; a metal drag secured to the drag die plate, the metal drag having a drag pushing-out mechanism for pushing an as-cast product out of the metal drag; a pair of opposing cope tilting shafts horizontally disposed on a horizontal axis and secured to an upper end of the main frame at locations rearward of the main rotating shafts; a cope-attaching frame rotatably mounted at one end on the cope tilting shafts; a cope die plate secured to a lower surface of the cope-attaching frame; and a metal cope secured to the cope die plate, the metal cope having a cope pushing-out mechanism for pushing an as-cast product out of the metal cope, wherein the center of the metal cope and drag assembly is substantially on the axis of rotation of the main rotating shafts.

DESCRIPTION OF THE PREFERRED EMBODIMENT

Figure 1:
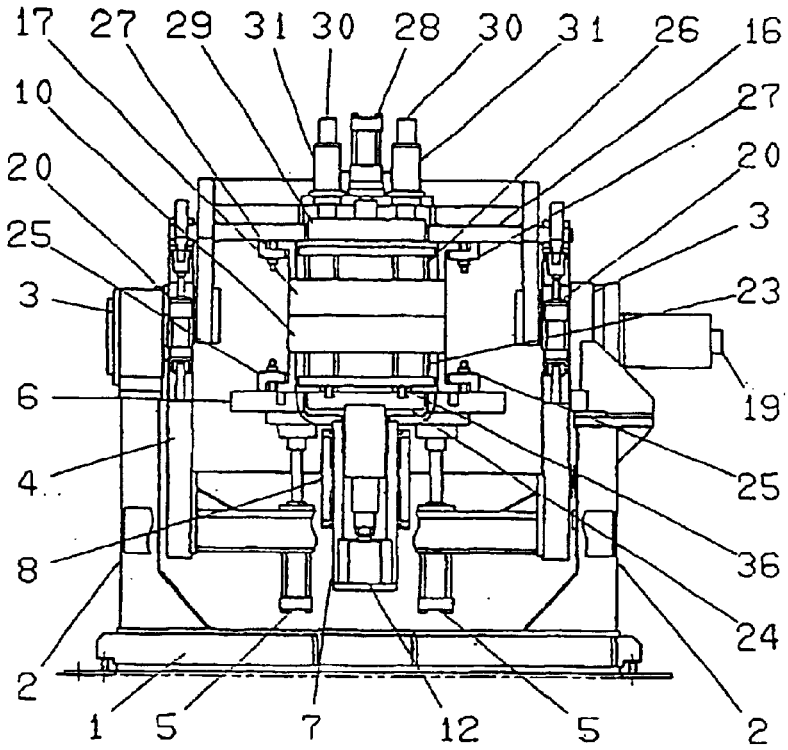
FIG. 1 is a schematic front view of the embodiment of the gravity type tiltable metal mold casting machine of the present invention.
Figure 2:
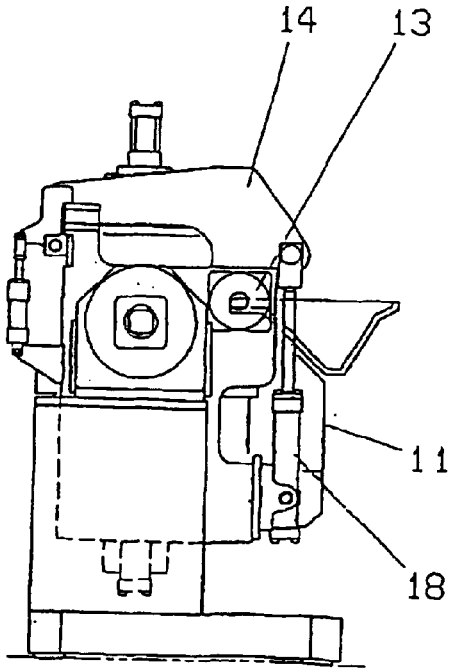
FIG. 2 is a side view of the machine shown in FIG. 1.

Below the embodiment of the present invention is explained in detail by reference to the accompanying drawings. In FIGS. 1 and 2 a pair of opposing upright frames 2, 2 are mounted on a base 1. A pair of opposing main rotating shafts 3, 3 are disposed on an axis and rotatably mounted on the upper ends of the upright frames 2, 2. A main frame 4 is fixedly mounted on the main rotating shafts 3, 3 such that it is suspended from and between them. For reversibly rotating the main frame 4A, a main electric motor 19, such as a servomotor, is mounted on one of the supporting frames 2, 2. The output shaft of the main electric motor 19 for reversibly rotating the main frame 4 is connected to one end of one of the main rotating shafts 3, 3.

A plurality of upwardly-facing cylinders 5, 5, for fastening the molds, are mounted on a lower part of the main frame 4. A drag die plate 6 is secured to the distal ends of the piston rods of the mold-fastening cylinders 5, 5. A hollow guide rod 7 is connected to the central part of the lower surface of the drag die plate 6. The hollow guide rod 7 slides vertically in a guide tube 8, which is fixed to a lower part of the main frame 4, for guiding the drag die plate 6 that is being moved vertically.

A metal drag 10, which has a drag pushing-out mechanism 23 for pushing out an as-cast product from the drag 10, is secured on the drag die plate by drag clamps 25, 25 mounted on the drag die plate at both sides of the metal drag 10. Further, a drag pushing-out cylinder 12 for actuating the drag pushing-out mechanism 23 is disposed inside the hollow guide rod 7, and a drag pushing plate 24 is connected to the distal end of the piston rod of the drag pushing-out cylinder 12. The drag pushing plate 24 is vertically movable through a central opening of the drag die plate 6 and is detachably connected to the drag pushing-out mechanism 23 by any known device.

A pair of opposing cope tilting shafts 13, 13, extending horizontally on an axis, are mounted on the upper end of the main frame 4 at positions rearward of the main rotating shafts 3, 3. A cope-attaching frame 14 is rotatably mounted at one end on the cope tilting shafts 13, 13.

A cope die plate 16 is attached to the lower surface of the cope-attaching frame 14, and a metal cope 17 is secured to the lower surface of the cope die plate 16 by cope clamps 27, 27 mounted on the cope die plate 16 at both sides of the metal cope 17. The metal cope 17 has a cope pushing-out mechanism 26 for pushing an as-cast product out of the metal cope 17. Further, a downwardly-facing cylinder 28 for actuating the cope pushing-out mechanism 26 is mounted on the cope-attaching frame 14. A cope pushing plate 29 is connected to the distal end of the piston rod of the cope pushing-out cylinder 28. The drag pushing plate 29 is vertically movable through a central opening of the cope die plate 16. A plurality of guide rods 30, 30 are mounted on the cope pushing plate 29. The guide rods 30, 30 slide in guiding tubes 31, 31, which are secured to the cope-attaching frame 14, for guiding the cope pushing plate 29 being moved vertically.

The numbers 18, 18 in the drawings denote cylinders for reversibly rotating the metal cope 17, and the numbers 20, 20 denote locking cylinders for locking the metal cope in position.

Figure 3:
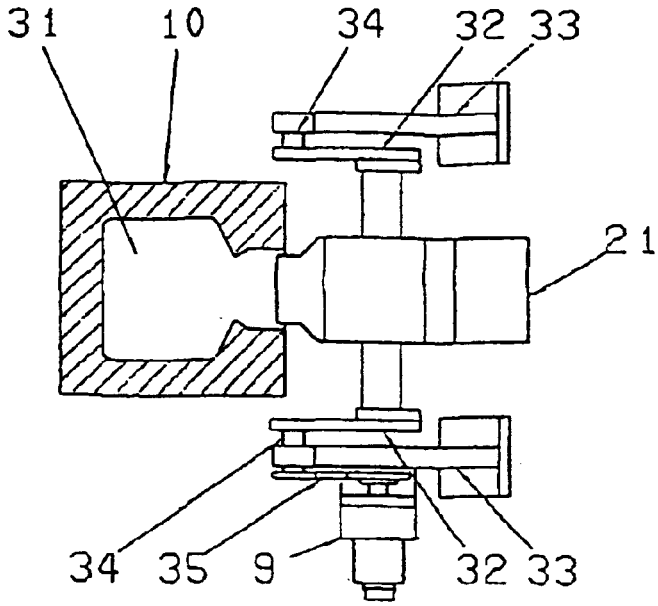
FIG. 3 is a cross-sectional view of a mechanism for rotating the ladle shown in FIG. 1.
Figure 4:
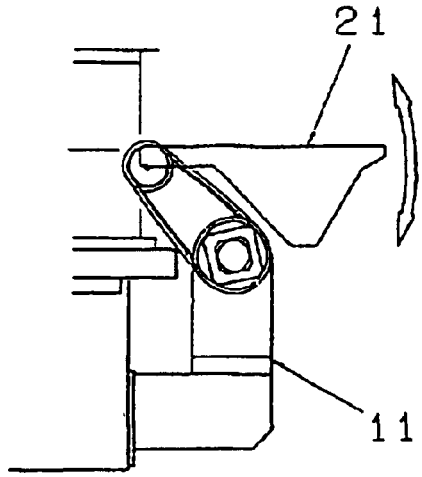
FIG. 4 is a vertical sectional view of the mechanism for rotating the ladle.

In FIGS. 3 and 4 a ladle rotating mechanism 11 is explained. A ladle 21 is disposed with its distal end being inserted into a mold cavity 31 that is defined by the metal cope 17 and drag 10 when they are mated with each other (i.e., when they are fastened). The ladle 21 is fixedly mounted on a pair of ladle-supporting frames 32, 32. The ladle-supporting frames are in turn rotatably mounted on the distal ends of a pair of arms, which are fixedly mounted on the main frame 4, through a pair of opposing ladle-rotating shafts 34, 34, which are aligned with each other on a horizontal axis. One of the ladle-rotating shafts 34, 34 is connected to an electric motor 9 (such as a servomotor) for reversibly rotating the ladle 21 by a chain 35.

In the operation of the ladle rotating mechanism 11, the ladle-rotating motor 9 for reversibly rotating the ladle rotates the ladle rotating-shafts 34, 34 and hence ladle-supporting frames 32, 32 and the ladle 21. Since the distal end of the ladle 21 lies on the axis on which the ladle rotating shafts 34, 34 are disposed, the ladle 21 rotates about its distal end.

Further, as is seen in FIG. 1, in the gravity type tiltable metal mold casting machine of the present invention the center of the cope and drag assembly (i.e., when they mate to be the assembly) is substantially on the common axis of rotation of the main rotating shafts 3, 3. Thus, when the cope and drag assembly is rotated by the main electric motor 19 for rotating the main frame 4, it substantially rotates about the common axis of rotation of the main rotating shafts 3, 3.

The operation of the gravity type tiltable metal mold casting machine configured as described above is now explained by reference to FIGS. 5–15.

An operation in which an as-cast product is taken out while it is being held in the cope 17 is explained first by reference to FIGS. 5–12. First, a set of a metal cope 17 and a metal drag 10 are set on the gravity type tiltable metal mold casting machine of the present invention. The cope clamps 27, 27 and the drag clamps 25, 25 are then fastened to secure the metal cope 17 and drag 10 to the cope die plate 16 and the drag die plate, respectively.

Figure 5:
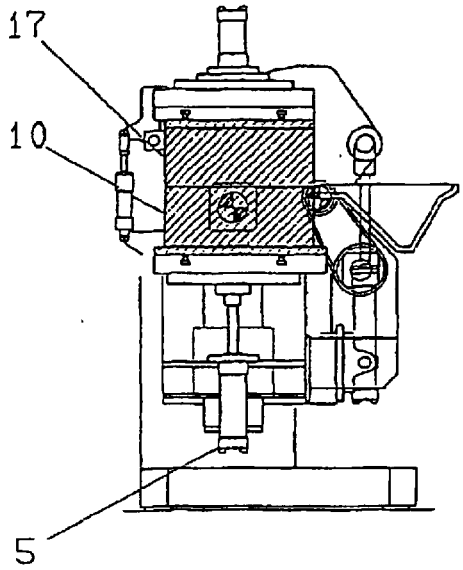
FIG. 5 is a side view similar to that of FIG. 2, showing a cope and a drag that have been secured to the machine.
Figure 6:
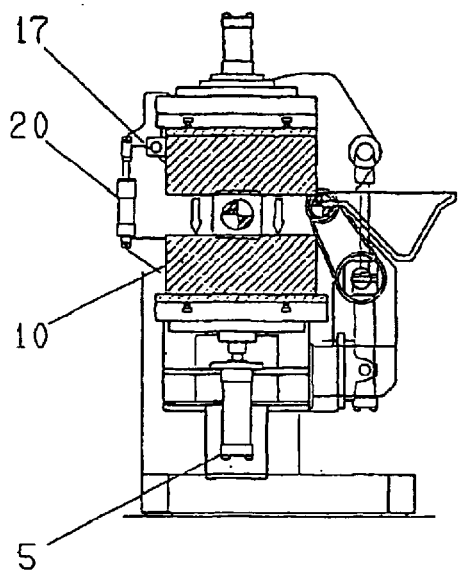
FIG. 6 is a side view, showing the drag being lowered and separated from its position shown in FIG. 5.

From the state as in FIG. 5 the mold-fastening cylinders 5, 5 then operate to retract their piston rods to lower and separate the metal cope 17 from the metal drag 10, as in FIG. 6.

Figure 7:
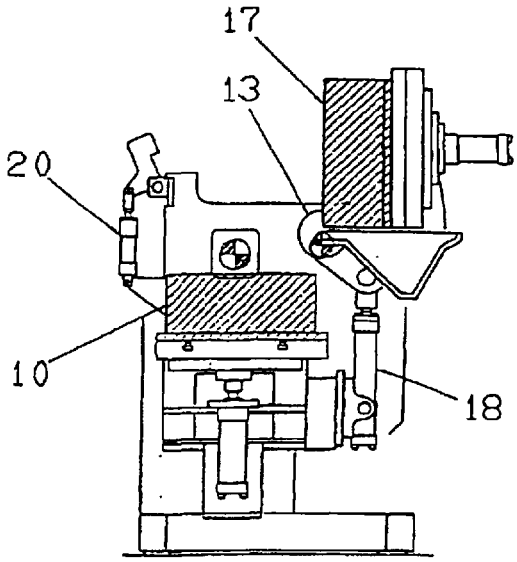
FIG. 7 is a side view, showing the cope being rotated through 90° clockwise about the cope tilting shafts from-its position shown in FIG. 6.
Figure 8:
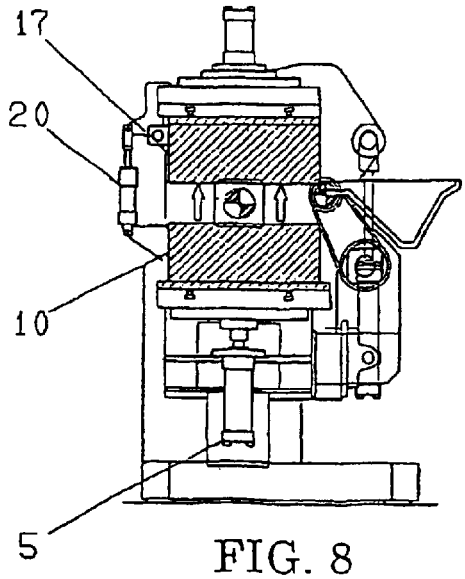
FIG. 8 is a side view, showing the cope being rotated through 90° counterclockwise from its position shown in FIG. 7 and then being locked.

The locking cylinders 20, 20 then operate to unlock the metal cope 17, and the cylinders 18, 18 for reversibly rotating the metal cope 17 then operate to rotate the metal cope through 90° clockwise about the cope tilting shafts 13, 13, as in FIG. 7.

Auxiliary operations such as putting cores in the metal drag, etc., are then carried out. After those operations, the cylinders 18, 18 operate to rotate the metal cope counterclockwise, and the locking cylinders 20, 20 then reversely operate to lock the metal cope, as in FIG. 8.

Figure 9:
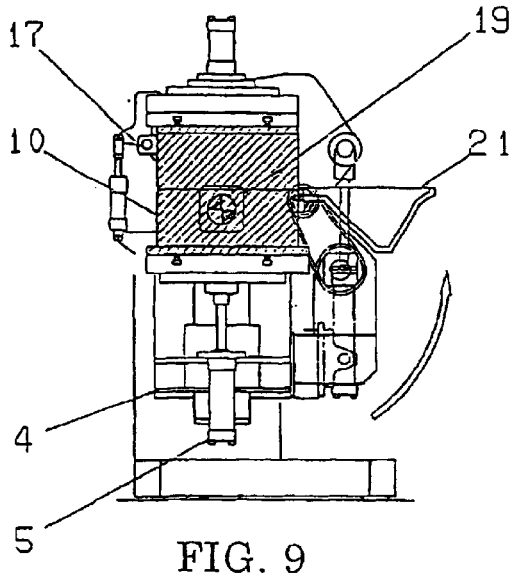
FIG. 9 is a side view, showing the drag being raised from its position shown in FIG. 8 and being fastened to the cope.

The mold-fastening cylinders 5, 5 then operate to extend their piston rods to fasten the metal drag 10 to the metal cope 17, as in FIG. 9.

Figure 10:
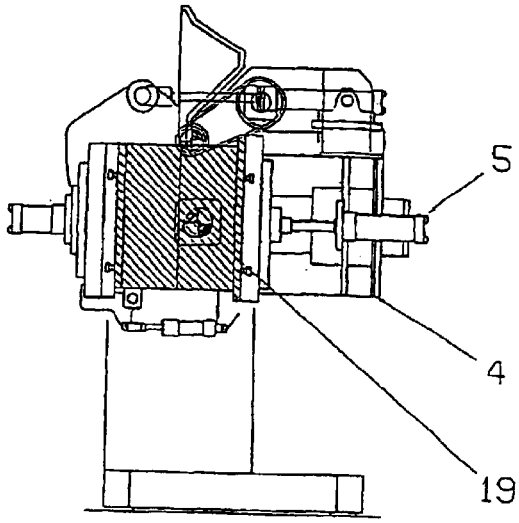
FIG. 10 is a side view, showing the entire device that is attached to a main frame of the machine being rotated through 90° counterclockwise for pouring molten metal from its position shown in FIG. 9.
Figure 11:
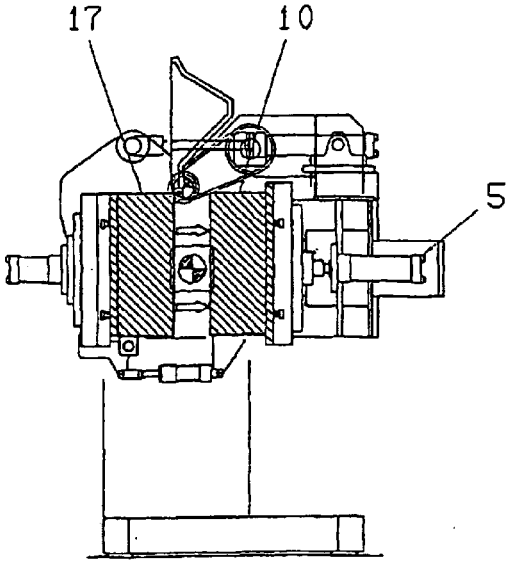
FIG. 11 is a side view, showing the drag being separated from the cope from its position shown in FIG. 10.
Figure 12:
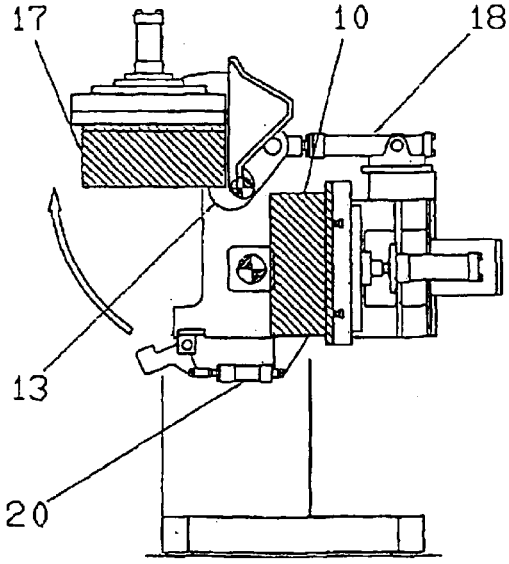
FIG. 12 is a side view, showing the cope being rotated through 90° clockwise about the cope tilting shafts from its position shown in FIG. 11.
Figure 13:
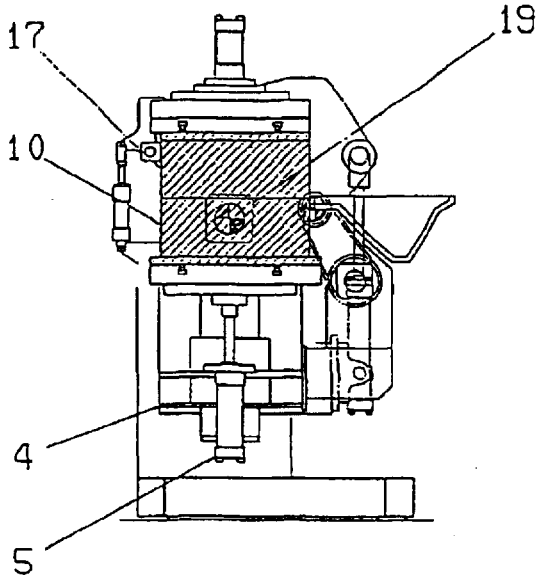
FIG. 13 is a side view, showing the main frame being rotated to return to its vertical position from the position shown in FIG. 10.
Figure 14:
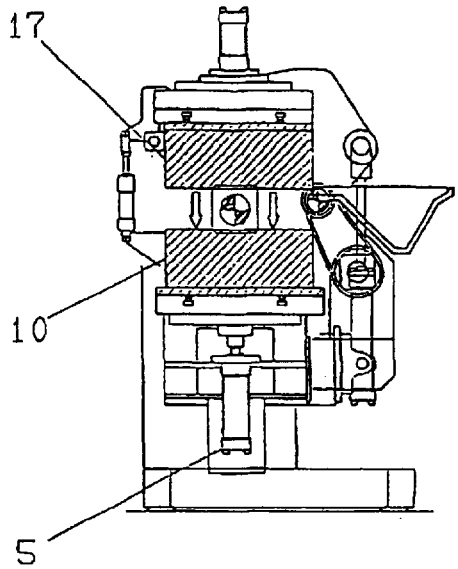
FIG. 14 is a side view, showing the drag being lowered from its position shown in FIG. 13.
Figure 15:
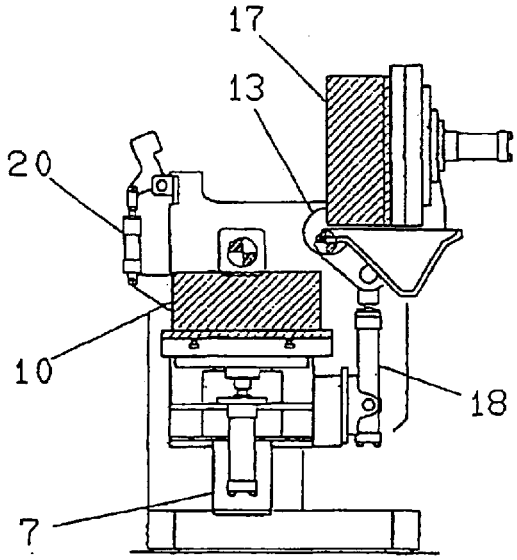
FIG. 15 is a side view, showing the cope being rotated about the cope tilting shafts from its position shown in FIG. 14.

The ladle is then provided with aluminum molten metal, and the main electric motor then operates to rotate the entire device that is attached to the main frame 4 through 90° counterclockwise about the main rotating shafts 3, 3, as in FIG. 10. Since during this rotation of the device, by which rotation the molten metal is poured into the mold cavity of the cope and drag assembly, the assembly is rotated about its center, its rotatory inertia caused by its swing is minimized. In other words, the assembly rotates at its lowest possible peripheral speed. Accordingly, this does not exert great inertia to the molten metal poured into the cavity., thus causing less rebounding or dancing of the molten metal in the cavity, and preventing the air and the oxide films from being convoluted in the molten metal. Thus it is smoothly poured into the cavity.

If the ladle 21 were not rotated by the ladle-rotating motor 9 with respect to the cope and drag assembly, the amount of the aluminum molten metal to be poured from the ladle 21 into the cavity 31 would be defined only by the angle of rotation of the assembly, and the amount of the aluminum molten metal that could be poured into the cavity 31 of the cope and the drag assembly at its given angle of rotation would be defined by the shape of the cavity 31. However, if the ladle 21 is rotated appropriately clockwise or counter-clockwise by the ladle-rotating motor 9 when the cope and drag assembly is rotated so as to pour the required, appropriate amount of the molten metal into the cavity 31, the required, appropriate amount of the molten metal is poured, and the air and the oxide films are prevented from being convoluted in the molten metal, thus allowing a smooth pouring.

After the cope and drag assembly and the ladle 21 are rotated by the main electric motor 19 and the ladle-rotating motor 9, respectively, the position of the assembly shown in FIG. 10 is maintained for a given period of time until the molten metal solidifies.

The drag pushing-out cylinder 12 is then extended to raise the drag pushing plate 24 to actuate the drag pushing-out mechanism 23, while mold-fastening cylinders 5, 5 are being retracted to separate the metal drag 10 from the metal cope 17. During this separation the as-cast product is removed from the metal drag 10 and is held by the metal cope 17. The locking cylinders 20, 20 then operate to unlock the metal cope 17, and the cylinders 18, 18 then operate to rotate the metal cope 17 about the cope tilting shafts 13, 13, as in FIG. 12. The cope pushing-out cylinder 28 is then extended to push down the cope pushing plate to actuate the cope pushing-out mechanism 26, thereby removing the as-cast product from the metal cope 17. The removed as-cast product is received by a dish of a product-taking-out device (neither are shown).

The main electric motor 19 then operates to rotate the frame 4, as in FIG. 7, for the next auxiliary process of cleaning the metal cope 17 and drag 10, putting cores in the metal drag 10, etc. The operations explained above regarding FIGS. 7–12 are repeated.

Second, the operation in which an as-cast product is taken out while being held in the metal drag 10 is now explained. The process explained above regarding FIGS. 5–10 is performed. The main electric motor 19 then operates to rotate the main frame 4 about the main rotating shafts 3, 3 to be in the upright position shown in FIG. 13. The cope pushing-out cylinder 28 is then extended to push the cope pushing plate 29 to actuate the cope pushing-out mechanism 26, while the mold-fastening cylinders 5, 5 are retracted to separate the metal drag 10 from the metal cope 17, as in FIG. 14. During this separation the as-cast product is held by the metal drag 10.

The locking cylinders 20, 20 then operate to unlock the cope 17, and the cylinders 18, 18 then operate to rotate the metal cope 17 about the cope tilting shafts 13, 13. The drag pushing-out cylinder 12 is then extended to push the drag pushing plate 24 to actuate the drag pushing-out mechanism 23, and the as-cast product is taken out by the product-taking-out device (not shown), as in FIG. 15. The auxiliary process of cleaning the metal cope and drag, putting cores in the metal drag, etc., is then carried out, and the above operation is then repeated.

The main frame 4 of the embodiment may be placed in position by a positioning stopper (not shown), except when it is tilted.

It should be understood that the embodiments described above are exemplary only, and many variations can be made to them. Thus the present invention includes such variations, and the scope of the invention is defined by the attached claims.

For example, in the above embodiment the cope die plate 16 is rotatable, while the drag die plate 6 is moved linearly. The movement of both plates 16, 6 is not limited to such movements, and, for example, the drag die plate 6 may be rotatable, while the cope die plate 16 may be moved linearly.

As discussed above, since in this invention the metal cope is rotated about a horizontal axis located behind the axis of rotation of the mold assembly, the metal drag can be opened to be easily accessed when the metal cope is opened. Further, since the cope and die assembly are tilted substantially about the center of the assembly, it will have low rotatory inertia when tilted, causing less rebounding or dancing of the molten metal. Further, since the ladle is rotated by an electric motor independently of the rotation of the mold assembly, a sufficient, but not excessive, and required amount of the molten metal is poured into the mold cavity, thus preventing the air and the oxide films from being convoluted in the molten metal. Further, since the swinging of the mold assembly is minimized, the machine can be compact. Further, use of an electric cylinder (such as a servomotor) for tilting the mold assembly, rather than a conventional oil hydraulic cylinder, allows the assembly to tilt precisely, thus enabling the tilting movement to be repeated, which tilting movement can be stored in a memory and when necessary called any time.

Further, since in the present invention the guide rod for guiding the vertical movement of the cope die plate is hollow, and the drag pushing-out cylinder for pushing an as-cast product out of the drag is disposed within that hollow guide rod, the device positioned below the drag can be of a low profile, thus allowing an operator to carry out the operations of putting cores in the drag and taking an as-cast product out of the metal cope or drag without preparing a pit or a worktable.

What is claimed is:

1. A gravity type tiltable metal mold casting machine, comprising:

a pair of opposing upright supporting frames (2, 2);

a pair of opposing main rotating shafts (3, 3) disposed on an axis of rotation and rotatably mounted on the upper ends of the upright supporting frames (2, 2);

a main frame (4) fixedly mounted on the main rotating shafts (3, 3) such that the main frame is suspended from and between the main rotating shafts (3, 3);

an electric motor (19) attached to one of the main rotating shafts (3, 3) for reversibly rotating the main rotating shaft (3) and hence the frame (4);

a drag die plate (6) vertically moved by mold-fastening cylinders (5, 5) mounted on a lower part of the main frame (4);

a metal drag (10) secured to the drag die plate (6), the metal drag having a drag pushing-out mechanism (23) for pushing an as-cast product out of the metal drag;

a pair of opposing cope tilting shafts (13, 13) horizontally disposed on a horizontal axis and secured to an upper end of the main frame at locations rearward of the main rotating shafts (3, 3);

a cope-attaching frame (14) rotatably mounted at one end on the cope tilting shafts (13, 13);

a cope die plate (16) secured to a lower surface of the cope-attaching frame (14); and a metal cope (17) secured to the cope die plate (16), the metal cope having a cope pushing-out mechanism (26) for pushing an as-cast product out of the metal cope (17);

a ladle (21) rotatably mounted about a horizontal axis of rotation, the horizontal axis of rotation being located rearward of the assembly of the metal cope and drag; and an electric motor (9) for reversibly rotating the ladle (21) about the horizontal axis of rotation, wherein the center of the assembly of the metal cope and drag is substantially on the axis of rotation of the main rotating shafts (3, 3).

2. The casting machine of claim 1, further including a hollow guide rod (7) for guiding the cope die plate (6), wherein the drag pushing-out cylinder (12) for pushing the as-cast product out of the metal drag is disposed within the hollow guide rod (7).

* * * * *